US007288511B2

(12) United States Patent
Doyel et al.

(10) Patent No.: US 7,288,511 B2
(45) Date of Patent: Oct. 30, 2007

(54) CLEANING COMPOSITIONS CONTAINING DICHLOROETHYLENE AND SIX CARBON ALKOXY SUBSTITUTED PERFLUORO COMPOUNDS

(75) Inventors: Kyle Doyel, Nashville, TN (US); Michael Bixenman, Old Hickory, TN (US)

(73) Assignee: Kyzen Corporation, Nashville, TN (US)

( * ) Notice: Subject to any disclaimer, the term of this patent is extended or adjusted under 35 U.S.C. 154(b) by 301 days.

(21) Appl. No.: 10/694,747

(22) Filed: Oct. 29, 2003

(65) Prior Publication Data

US 2004/0224870 A1 Nov. 11, 2004

Related U.S. Application Data

(62) Division of application No. 10/164,308, filed on Jun. 7, 2002, now Pat. No. 6,699,829.

(51) Int. Cl.
*C11D 7/50* (2006.01)

(52) U.S. Cl. ..... 510/412; 510/408; 510/410; 510/177; 510/288

(58) Field of Classification Search ..... None
See application file for complete search history.

(56) References Cited

U.S. PATENT DOCUMENTS 5,037,372 A 8/1991 Weder
5,039,445 A 8/1991 Merchant
5,064,560 A 11/1991 Merchant
5,073,288 A 12/1991 Anton
5,196,137 A 3/1993 Merchant
5,250,213 A 10/1993 Rozen et al.
5,654,129 A 8/1997 Taylor
5,679,175 A 10/1997 Hayes et al.
5,716,457 A 2/1998 Hayes et al.
5,759,986 A 6/1998 Merchant et al.
5,814,595 A * 9/1998 Flynn et al. ..... 510/411
5,824,634 A * 10/1998 Merchant ..... 510/412
5,827,446 A 10/1998 Merchant et al.
5,827,812 A 10/1998 Flynn et al.
5,851,436 A 12/1998 Merchant et al.
5,851,977 A 12/1998 Gorton et al.
5,856,286 A * 1/1999 Nalewajek et al. ..... 510/288
5,908,822 A 6/1999 Dishart
5,925,611 A * 7/1999 Flynn et al. ..... 510/412
5,953,814 A 9/1999 Sozansky et al.
5,962,390 A 10/1999 Flynn et al.
5,962,412 A 10/1999 Hogan, Jr.
5,989,359 A 11/1999 Berbel
6,008,179 A 12/1999 Flynn et al.
6,030,934 A * 2/2000 Owens et al. ..... 510/411
6,053,952 A 4/2000 Kaiser
6,063,748 A 5/2000 Flynn et al.
6,153,575 A 11/2000 Gorton et al.
6,187,729 B1 2/2001 Hayes et al.
6,194,619 B1 2/2001 Rao et al.
6,235,700 B1 5/2001 Flynn et al.
6,255,275 B1 7/2001 Kadono et al.
6,274,543 B1 * 8/2001 Milbrath et al. ..... 510/412
6,281,185 B1 8/2001 Owens et al.
6,288,017 B1 9/2001 Flynn et al.
6,288,018 B1 9/2001 Flynn et al.
6,291,417 B1 * 9/2001 Flynn et al. ..... 510/412
6,310,018 B1 * 10/2001 Behr et al. ..... 510/175
6,313,083 B1 11/2001 Flynn et al.
6,342,471 B1 1/2002 Jackson
6,380,149 B2 4/2002 Flynn et al.
6,746,998 B2 * 6/2004 Fitzgerald ..... 510/410
6,770,614 B2 * 8/2004 Miller et al. ..... 510/411

* cited by examiner

*Primary Examiner*—Gregory Webb
(74) *Attorney, Agent, or Firm*—Crowell & Moring LLP

(57) ABSTRACT

Chemical solvating, degreasing, stripping and cleaning agents. The agents are cleaning and solvating mixtures of dichloroethylene and alkoxy-substituted perfluoro compounds that contain six carbon atoms, with optionally highly fluorinated materials to retard flammability and/or other enhancement agents that improve and enhance the properties of the composition to accomplish its desired cleaning or solvating task. These other agents are one or more of the following materials: alcohols, esters, ethers, cyclic ethers, ketones, alkanes, aromatics, amines, siloxanes terpenes, dibasic esters, glycol ethers, pyrollidones, or low- or non-ozone depleting halogenated hydrocarbons. These mixtures are useful in a variety of solvating, vapor degreasing, photoresist stripping, adhesive removal, aerosol, cold cleaning, and solvent cleaning applications including defluxing, dry-cleaning, degreasing, particle removal, metal and textile cleaning.

15 Claims, No Drawings

CLEANING COMPOSITIONS CONTAINING DICHLOROETHYLENE AND SIX CARBON ALKOXY SUBSTITUTED PERFLUORO COMPOUNDS

This application is a division of application Ser. No. 10/164,308, filed Jun. 7, 2002 now U.S. Pat. No. 6,699,829.

BACKGROUND AND SUMMARY OF THE INVENTION

The present invention relates to chemical solvating, degreasing, stripping and cleaning agents. More particularly, this invention relates to cleaning and solvating compositions containing dichloroethylene and six carbon length hydrofluoroethers and/or other agents that improve and enhance the properties of the original mixture.

The present invention was made in response to concerns with ozone depleting materials, and toxicity concerns with non-ozone depleting chlorinated materials. In September 1987, the United States and 22 other countries signed the Montreal Protocol on Substances that Deplete the Ozone Layer (the "Protocol"). The Protocol called for a freeze in the production and consumption of ozone depleting chemicals ("ODP's" or "ODC's") by the year 2000 for developed countries and 2010 for developing countries. In 1990 the United States enacted the Clean Air act mandating that the use of ozone depleting chemicals be phased out by the year 2000. In September 1991, the U.S. Environmental Protection Agency announced that ozone layer depletion over North America was greater than expected. In response to this announcement, President George H. W. Bush issued an executive order accelerating the phase-out of the production of ozone depleting materials to Dec. 31, 1995. More than 90 nations, representing well over 90% of the world's consumption of ODP's, have now agreed to accelerate the phase-out of production of high ozone depleting materials to Dec. 31, 1995 for developed countries and Dec. 31, 2005 for developing countries pursuant to the protocol.

Historically fluorine and chlorine based solvents were widely used for degreasing, solvating, solvent cleaning, aerosol cleaning, stripping, drying, cold cleaning, and vapor degreasing applications. In the most basic form the cleaning process required contacting a workpiece with the solvent to remove an undesired material, soil or contaminant. In solvating applications these materials were added to dissolve materials in such applications as adhesive or paint formulations.

Cold cleaning, aerosol cleaning, stripping and basic degreasing were simple applications where a number of solvents were used. In most of these processes the soiled item was immersed in the fluid, sprayed with the fluid, or wiped with cloths or similar objects that had been soaked with the fluid. The soil was removed and the item was allowed to air dry.

Drying, vapor degreasing and/or solvent cleaning consisted of exposing a room temperature workpiece to the vapors of a boiling fluid or directly immersing the workpiece in the fluid. Vapors condensing on the workpiece provided a clean distilled fluid to wash away soils and contaminants. Evaporation of the fluid from the workpiece provided a clean item similar to cleaning the same in uncontaminated fluid.

More difficult cleaning of difficult soils or stripping of siccative coatings such as photomasks and coatings required enhancing the cleaning process through the use of elevated fluid temperatures along with mechanical energy provided by pressure sprays, ultrasonic energy and or mechanical agitation of the fluid. In addition these process enhancements were also used to accelerate the cleaning process for less difficult soils, but were required for rapid cleaning of large volumes of workpieces. In these applications the use of immersion into one or more boiling sumps, combined with the use of the above mentioned process enhancements was used to remove the bulk of the contaminant. This was followed by immersion of the workpiece into a sump that contained freshly distilled fluid, then followed by exposing the workpiece to fluid vapors which condensed on the workpiece providing a final cleaning and rinsing. The workpiece was removed and the fluid evaporated. Vapor degreasers suitable in the above-described process are well known in art.

In recent years the art was continually seeking new fluorocarbon based mixtures which offered similar cleaning characteristics to the chlorinated and chlorofluorocarbon (CFC) based mixtures and azeotropes. In the early 1990's materials based on the compounds of hydrochlorofluorocarbons (HCFC) began to appear. Three molecules in particular 1,1-dichloro-1-fluoro ethane (HCFC-141b), dichloro trifluoro ethane (HCFC-123), and dichloro pentafluoro propane (HCFC-225) were proposed as replacements for methyl chloroform and CFC blends. As more highly fluorinated materials these materials were less ozone depleting than current ODP's however these materials were weaker solvents and in order to properly clean required the use of co-solvents through the use of blends and azeotropes. Later toxicity studies performed on these materials, however, showed them to have unacceptable character for broad commercial use in cleaning applications. Consequently HCFC-123 was immediately limited in cleaning use, and HCFC-141b was phased out in the U.S. by Apr. 1, 1997. HCFC-225 is still used, however the material is scheduled for phase out by the Clean Air Act after the year 2010. Toxicity concerns with HCFC-225 exist to some users and the recommended commercial exposure level of blends of the various isomers of the material is 100 ppm.

In the mid 1990's another art emerged through the use of brominated solvents similar in structure to ozone depleting chlorofluorocarbons. Three molecules were proposed as viable products to replace ODP's, bromochloromethane (BCM), isopropyl bromide (iBP) and n-propyl bromide (nPB). Although all three materials have excellent cleaning solvency for many soils, the first two materials BCM and iBP have been eliminated due to potential health risks. The third candidate nPB has undergone a number of toxicity tests with the results being inconclusive. Currently most reputable producers of nPB are indicating a safe 8-hour TLV level of 25 ppm, which is of some concern to some users.

The art in the mid 1990's changed as aqueous and semi-aqueous materials became the major choice of replacement for ODP's. The shift to these materials however had two drawbacks for some users. First was the requirement for new cleaning apparatus and machinery capable of handling and drying water. The second was the fact that certain niche applications in the marketplace could not tolerate the use of water in the cleaning process due to damage to the workpiece. This damage was caused by either incompatibility of water with the workpiece, or residual water remaining on the workpiece due to the geometry of the workpiece. This second factor resulted in the art shifting to processes cleaning with solvents and either rinsing with volatile flammable solvents such as acetone hexane, cyclohexane and isopropanol, or rinsing with highly fluorinated materials called perfluorocarbons (PFC's).

These PFC rinsing agents were investigated by some users. Other solvents such as low molecular weight alcohols, ketones and alkanes, were also evaluated since they provided users with acceptable rinsing and cleaning, however they were flammable and concerns were raised about their use in production applications. Systems that operated with these inexpensive solvents were very expensive and required explosion-proof machinery and buildings. Perfluorocarbons were deemed to be viable replacements in that they could potentially be operated in inexpensive vapor degreasing equipment such as was used for CFC's. Additionally these materials were inert, inflammable, and had very low toxicity. However, being inert these materials had no solvency, i.e., they did not dissolve the soils they were meant to remove from the workpieces, and were found to be poor cleaning materials. Other perceived drawbacks with these rinsing agents were that they were extremely expensive and required the use of modified vapor degreasers. Later work conducted by the U.S. EPA deemed PFC's to be unacceptable materials due to the fact that they had huge global warming potentials and would remain in the environment for thousands of years.

The art then evolved today to seeking materials for these specialty applications that required PFC like materials that had lower global warming potentials. Highly fluorinated materials such as hydrofluorocarbons (HFC's) and hydrofluoroethers (HFE's) and other highly fluorinated compounds are the result of the most recent disclosures. Like PFC, HFC's and HFE's exhibit the same characteristics, with the exception they are slightly less expensive than PFC's but are still orders of magnitude more expensive than CFC's and chlorinated solvents. Primarily used as rinsing, drying and inserting agents these materials exhibit poor solvency for the soils commonly encountered in most cleaning applications, and will require the use of solvent blends, co-solvent systems, and azeotrope like blends in order to effectively clean.

As a replacement for CFC compounds and mixtures in cleaning applications, the use of highly fluorinated materials HFE's or HFC's have been described in a number of patents in combination with dichloroethylenes and other halogenated solvents. Most of the disclosed blends contain mixtures with highly fluorinated materials containing two to six carbon atoms. In industrial practice blends containing little or no dichloroethylene or halogenated solvents are only useful in cleaning light oils and particulates since the highly fluorinated materials have little cleaning efficacy. Mixtures having dichloroethylene or halogenated solvents as the major component are known to be more effective in cleaning a broader array of soils and thus are preferred.

The use of an HFC, decafluoropentane,(a 5 carbon highly fluorinated material) is disclosed in U.S. Pat. No. 5,196,137. This patent discloses the binary azeotrope of 1,1,1,2,3,4,4,5,5,5-decafluoropentane (HFC-4310mee) with cis- or trans-1,2-dichloroethylene. U.S. Pat. No. 5,064,560 discloses the ternary azeotropes of HFC-4310 mee with trans-1,2-dichloroethylene and with methanol or ethanol. U.S. Pat. No. 5,759,986 discloses the ternary azeotrope of HFC-4310 mee with trans-1,2-dichloroethylene (trans DCE) and cyclopentane, and the quaternary azeotrope of the three materials plus methanol. All the above listed mixtures produce non-flammable, azeotrope-like mixtures with the highest claimed level of dichloroethylene in any of the patents being 50%.

The use of an HFE is disclosed in a number of patents. U.S. Pat. No. 5,827,812 discloses a number of binary azeotrope-like mixtures with two isomers of perfluorobutyl methyl ether (HFE-7100), a highly fluorinated 5 carbon molecule. Included in disclosed binary azeotropes are trans and cis 1,2-dichloroethylene, methylene chloride, nPB and HCFC-225. U.S. Pat. No. 6,008,179 discloses binary azeotrope-like mixtures between HFE-7100 and methanol, ethanol, 1-propanol, 2-butanol, isobutanol, and tert-butanol. In addition it names ternary azeotrope-like mixtures between HFE-7100, trans DCE and methanol, ethanol, 1-propanol, 2-propanol (IPA), and tert-butanol. Further the patent discloses other ternary azeotrope-like mixtures between HFE-7100, HCFC-225 (a hydrofluorinated-chlorinated solvent) and methanol or ethanol. Most of the combinations with HFE-7100 described in these patents are non-flammable and show acceptable flammability character when high levels of HFE-7100 are present. Ternary azeotrope like combinations with halogenated solvents are not as flammable but like HFC-4310, form azeotrope-like mixtures at dichloroethylene levels of near and/or less than 50 wt % of the mixture.

The use of another HFE material, perfluorobutyl ethyl ether (HFE-7200, a six carbon highly fluorinated material) is described U.S. Pat. Nos. 5,814,595, 6,235,700 and in 6,288,018. These patents describe a number of binary azeotrope-like mixtures with two isomers of the perfluorobutyl ethyl ether. All binary combinations are shown to be flammable with the exception of azeotropes with the following halogenated solvents: hexafluoro-2-propanol, 1,2-dichloropropane and trans DCE. The combination with trans DCE is the most interesting aspect of this patent because the material forms an azeotrope-like product at 62.7 to 68.8 wt % trans DCE depending on the HFE-7200 isomer mixture.

The family of HFE materials are fully described in U.S. Pat. No. 6,291,417. This patent teaches the use of highly fluorinated ethers described in general as alkoxy-substituted perfluorocompounds in combination at least one co-solvent selected from a group of multiple chemical families. The patent claims that the fluorinated ether component must be at least 30% by weight of the composition and more preferred to be at least 50% of the mixture (a majority of the mixture) and most preferred to be greater than 60%.

Dichloroethylene compositions are described in U.S. Pat. No. 5,851,977. The patent discloses the use of 1,2-dichloroethylene in combination with a specific group of selected 3 and 4 carbon halogenated alkanes and alcohols. In the described patent the halogenated alkanes and alcohols are used to retard the flash point of the dichloroethylene.

U.S. Pat. Nos. 5,654,129 and 5,902,412 describe non-azeotrope mixtures of dichloroethylene and perchloroethylene that can be used to clean photographic films and other general substrates. The perchloroethylene is used in the formulation to retard the flash point of the dichloroethylene.

There currently is a need for azeotrope or azeotrope like compositions that are able to clean difficult soils and fluxes that are not effectively cleaned today by current art. Preferably these compositions would be non-flammable, effective cleaning, have little or no ozone depletion potential and have relatively short atmospheric lifetime so that they do not contribute to global warming.

The present invention provides a solvent mixture which can be used in solvating, vapor degreasing, photoresist stripping, adhesive removal, aerosol, cold cleaning, and solvent cleaning applications including defluxing, dry-cleaning, degreasing, particle removal, metal and textile cleaning. Non-limiting examples of the soils and contaminants that are removed by the composition of the present invention are oil, grease, coatings, flux, resins, waxes, rosin, adhesives, dirt, fingerprints, epoxies, polymers, and other common contaminants found in the art.

The present cleaning and solvating compositions comprise dichloroethylene compounds and alkoxy-substituted perfluoro compounds that contain six carbon atoms (HFE6C). The compositions also include highly fluorinated materials to retard flammability and/or other enhancement agents that improve and enhance the properties of the original mixture. The addition of these agents to the composition will modify the physical and/or cleaning characteristics of the dichloroethylene/HFE6C mixture to accomplish its desired cleaning or solvating task. The highly fluorinated material is any fluorinated hydrocarbon material in which the number of fluorine atoms exceeds the number of hydrogen atoms on the molecule. The enhancement agents are one or more of the following materials: alcohols, esters, ethers, cyclic ethers, ketones, alkanes (including cyclic alkanes), aromatics, amines, siloxanes, terpenes, dibasic esters, glycol ethers, pyrollidones, or low or non ozone depleting halogenated hydrocarbons. These mixtures are useful in a variety of solvating, vapor degreasing, photoresist stripping, adhesive removal, aerosol, cold cleaning, and solvent cleaning applications including defluxing, dry cleaning, degreasing, particle removal, metal and textile cleaning. In particular, the composition comprising the dichloroethylene compounds and alkoxy-substituted perfluoro compounds that contain six carbon atoms (HFE6C), with highly fluorinated materials to retard flammability and/or other enhancement agents that improve and enhance the properties of the mixture can be used to replace highly ozone depleting materials such as chlorofluorocarbons, methyl chloroform, hydrochlorofluorocarbons or chlorinated solvents. In addition these mixtures will be more robust cleaning agents versus present art that uses HFC's and HFE's.

In the novel cleaning compositions of the present invention, dichloroethylene materials include 1,1-dichloroethylene, 1,2-cis-dichloroethylene and 1,2-trans-dichloroethylene.

Alkoxy-substituted perfluoro compounds that contain six carbons (HFE6C) include all isomers of perfluorobutane ethyl ether ($C_4F_9$—O—$C_2H_5$) and all isomers of perfluoropentane methyl ether ($C_5F_{11}$—O—$CH_3$).

Highly fluorinated materials used in this invention are compounds of the formula $C_aF_bH_cX_d$ where a is an integer from 2 to 8, b is an integer greater than a but less than 2a+2, d is 0, 1, or 2, and c is less than or equal to 2a+2−b−d. X can be O, N, halogen, or Si, in any possible combination as long as the number of F atoms exceeds the number of H atoms in the molecule. Throughout this specification and claims, by "halogen" is meant Cl, Br, and I.

Suitable enhancement agents are one or more of the following materials: alcohols, esters, ethers, cyclic ethers, ketones, alkanes, aromatics, amines, siloxanes, terpenes, dibasic esters, glycol ethers, pyrollidones, or low-or non ozone depleting-halogenated hydrocarbons.

The addition of the fluorinated compounds to the mixture will reduce and/or eliminate the flammability measured as the closed and/or open cup flash points of the mixture. In addition the proper selection of the materials in the mixture may create an azeotrope or azeotrope-like blend which is desirable. Furthermore, those skilled in the art would be aware of other additives such as surfactants, colorants, dyes, fragrances, indicators, inhibitors, and buffers as well as other ingredients which modify the properties of the mixture.

The dichloroethylene component of the mixture contains effective amounts of 1,1-dichloroethylene, 1,2-cis-dichloroethylene and 1,2-trans-dichloroethylene. They are usable either singly or as a mixture of two or more. Among the most preferred are 1,2-trans- and 1,2-cis-dichloroethylene.

The alkoxy-substituted perfluoro compounds that contain six carbon atoms (HFE6C) are all isomers of perfluorobutane ethyl ether ($C_4F_9$—O—$C_2H_5$) and perfluoropentane methyl ether ($C_5F_{11}$—O—$CH_3$). Examples of these compounds are n-perfluorobutane ethyl ether, iso-perfluorobutane ethyl ether, tert-perfluorobutane ethyl ether, n-perfluoropentane methyl ether, 2-trifluoromethyl perfluorobutyl 1-methyl ether, 2-trifluoromethyl perfluorobutyl 2-methyl ether, 2-trifluoromethyl perfluorobutyl 3-methyl ether, 2-trifluoromethyl perfluorobutyl 4-methyl ether, 2,2-trifluoromethyl perfluoropropyl 1-methyl ether.

The highly fluorinated materials of this invention are compounds of the formula $C_xF_yH_zX_a$ where x is 2-8, y>x and z<y; and a can be 0 or greater. X can be O, N, halogen, or Si, in any possible combination as long as the number of F atoms exceeds the number of H atoms in the molecule. Examples of suitable fluorinated materials are tetrafluoroethane, pentafluoroethane, perfluoroethane, pentafluoropropane, hexafluoropropane, heptafluoropropane, perfluoropropane, hexafluorobutane, heptafluorobutane, octafluorobutane, nonafluorobutane, perfluorobutane, heptafluoropentane, octafluoropentane, nonafluoropentane, decafluoropentane, undecafluoropentane, perfluoropentane, octafluorohexane, nonafluorohexane, decafluorohexane, undecafluorohexane, dodecafluorohexane, tridecafluorohexane, and perfluorohexane. Other commercially available fluorinated compounds are: 3-chloro-1,1,1-trifluoropropane (HCFC-253fb); 1,1,1,3,3,5,5,5-octafluoropentane (HFC-458mfcf); 4-trifluoromethyl-1,1,1,2,2,3,3,5,5,5-decafluoropentane (HFC-52-13); 4-trifluoromethyl-1,1,1,2,2,5,5,5-octafluoropentane (HFC-54-11); 4-trifluoromethyl-1,1,1,2,2,3,5,5,5-nonafluoropentane (HFC-53-12); 1,1,1,2,3,4,4,5,5,5-decafluoropentane (HFC-43-10mee) 1,1,1,2,2,3,3,4,4,5,6-undecafluorohexane (HFC-54-11qe); 1,1,2,2,3,3,4,4-octafluorobutane (HFC-338pcc); 1,1,1,2,2,3,3,4,4-nonafluorobutane-4-methyl ether (HFE-7100); 1,1,1,2,2,3,4,4,4-nonafluoroisobutane-3-methyl ether (HFE-7100); 1,1,1,2,2,3,3,4,4-nonafluorobutane-4-ethyl ether (HFE-7200); 1,1,1,2,2,3,4,4,4-nonafluoroisobutane-3-ethyl ether (HFE-7200); 1,1,2,2,3,3,4,5-octafluorocyclopentane; pentafluoroethane (HFC-134); dichloro-trifluoroethane (HCFC-123); trichloro-tetrafluoropropane (HCFC-224); dichloro-pentafluoropropane (HCFC-225); dichloro-tetrafluoropropane (HCFC-234); chloro-pentafluoropropane (HCFC-235); chloro-tetrafluoropropane (HCFC-244); chloro-hexafluoropropane (HCFC-226); pentachloro-difluoropropane (HCFC-222); tetrachloro-trifluoropropane (HCFC-223); trichloro-trifluoropropane (HCFC-233) pentafluoropropane (HFC-245) nonafluorobutylethylene (PFBET) and 1-bromopropane. Fluoroalcholos such as trifluoroethanol can also be used. They can be used either singly or as a mixture of two or more. Among the most preferred are HFE-7100, HFC 43-10, HCFC-225, PFBET, 1-bromopropane and octafluorocyclopentane.

Other compounds may be added to the mixture to vary the properties of the cleaner or solvent to fit various applications. The addition of these other compounds may also assist in the formation of useful azeotropic compositions. An azeotropic composition is defined as a constant boiling mixture of two or more substances that behaves like a single substance. Azeotropic compositions are desirable because they do not fractionate upon boiling. This behavior is desirable because mixtures may be used in vapor degreasing equipment and or the material may be redistilled.

Since achieving a perfect azeotrope is not practical in industrial use, all mixtures are described as "azeotrope-like". The term "azeotrope-like composition" means a constant boiling or substantially constant boiling mixture of two or more substances that behave as a single substance, which therefore can distill without substantial compositional change. Constant boiling compositions, which are characterized as "azeotrope-like" will exhibit either a maximum, or minimum boiling point compared to non azeotropic mixtures of two substances at a given pressure.

As used herein, the terms azeotrope, azeotrope-like and constant boiling are intended to mean also essentially azeotropic or essentially constant boiling. In other words, included within the meaning of these terms are not only the true azeotropes, but also other compositions containing the same components in different proportions, which are true azeotropes or are constant boiling at other temperature and pressure. As is well recognized in this art, there is a range of compositions which contain the same components as the azeotrope, which will not exhibit essentially equivalent properties for cleaning, solvating and other applications, but will exhibit essentially equivalent properties as the true azeotropic composition in terms of constant boiling characteristics or tendency not to separate or fractionate on boiling.

The alcohol useful as an enhancement agent is of the formula $C_xH_yO_z$ where x is 1 to 12, preferably 1 to 8, more preferably 1 to 6, y is greater than x but less than 2x+2, and z is 1 to 3 provided that at least one O is a hydroxyl oxygen. Examples of these alcohols are methyl alcohol, ethyl alcohol, propyl alcohol, isopropyl alcohol, n-butyl alcohol, 2-butyl alcohol, t-butyl alcohol, 1-pentanol, 2-pentanol, 3-pentanol, allyl alcohol, 1-hexanol, 2-hexanol, 3-hexanol, 2-ethyl hexanol, 1-octanol, 1-decanol, 1-dodecanol, cyclohexanol, cyclopentanol, benzyl alcohol, furfuryl alcohol, tetrahydrofurfuryl alcohol, bis-hydroxymethyl tetrahydrofuran, ethylene glycol, propylene glycol, and butylene glycol. They can be used either singly or in the form of a mixture of two or more. Among the most preferred are methanol, ethanol, n-propanol, isopropanol, and tert butyl alcohol.

The ester useful as an enhancement agent is of the formula $R_1$—COO—$R_2$ where $R_1$ and $R_2$ could be the same or different, $R_1$ is hydrogen, $C_1$-$C_{20}$ alkyl, $C_5$-$C_6$ cycloalkyl, benzyl, furanyl or tetrahydrofuranyl, preferably $C_1$ to $C_8$ alkyl, more preferably $C_1$ to $C_4$ alkyl; $R_2$ is $C_1$-$C_8$ alkyl, preferably $C_1$ to $C_4$ alkyl, $C_5$-$C_6$ cycloalkyl, benzyl, phenyl, furanyl or tetrahydrofuranyl. Examples of these esters are methyl formate, methyl acetate, methyl propionate, methyl butyrate, ethyl formate, ethyl acetate, ethyl propionate, ethyl butyrate, propyl formate, propyl acetate, propyl propionate, propyl butyrate, butyl formate, butyl acetate, butyl propionate, butyl butyrate, methyl soyate, isopropyl myristate, propyl myristate, and butyl myristate. Among the most preferred are methyl formate, methyl acetate, ethyl acetate and ethyl formate.

The ether useful as an enhancement agent is of the formula $R_3$—O—$R_4$ where $R_3$ is $C_1$-$C_{10}$ alkyl or alkynl, $C_5$-$C_6$ cycloalkyl, benzyl, phenyl, furanyl or tetrahydrofuranyl, $R_4$ is $C_1$-$C_{10}$ alkyl or alkynyl, $C_5$-$C_6$ cycloalkyl, $C_1$-$C_4$ ether, benzyl, phenyl, furanyl or tetrahydrofuranyl. Examples of these ethers are ethyl ether, methyl ether, propyl ether, isopropyl ether, butyl ether, methyl tert butyl ether, ethyl tert butyl ether, vinyl ether, allyl ether, methylal, ethylal and anisole. In the composition listed $R_3$ and $R_4$, which can be the same or different, can be $C_1$ to $C_{10}$ alkyl or alkynyl, preferably $C_1$ to $C_6$ alkyl or alkynyl, more preferably $C_1$ to $C_4$ alkyl. Among the most preferred are isopropyl ether, methylal and propyl ether.

The preferred cyclic ethers are: 1,4-dioxane, 1,3-dioxolane, tetrahydrofuran (THF), methyl THF, dimethyl THF and tetrahydropyran (THP), methyl THP, dimethyl THP, ethylene oxide, propylene oxide, butylene oxide, amyl oxide, and isoamyl oxide. Most preferred is THF.

The ketone component of the mixture is of the formula: $R_5$—C═O—$R_6$ where $R_5$ is $C_1$-$C_{10}$ alkyl or alkynyl, $C_5$-$C_6$ cycloalkyl, benzyl, furanyl or tetrahydrofuranyl, $R_6$ is $C_1$-$C_{10}$ alkyl, $C_5$-$C_6$ cycloalkyl, benzyl, phenyl, furanyl or tetrahydrofuranyl. Examples of these ketones are acetone, methyl ethyl ketone, 2-pentanone, 3-pentanone, 2-hexanone, 3-hexanone, and methyl isobutyl ketone. $R_5$ and $R_6$, which can be the same or different, can be are, preferably $C_1$ to $C_6$ alkyl, more preferably $C_1$ to $C_4$ alkyl. Among the most preferred are acetone, methyl ethyl ketone, 3-pentanone and methyl isobutyl ketone.

The alkane useful as an enhancement agent is of the formula: $C_nH_{n+2}$ where n is 1-20, or $C_4$-$C_{20}$ cycloalkanes. Examples of these alkanes are butane, methyl propane, pentane, isopentane, methyl butane, cyclopentane, hexane, cyclohexane, isohexane, heptane, methyl pentane, dimethyl butane, octane, nonane and decane. n is preferably 4 to 9, more preferably 5 to 7. Among the most preferred are cyclopentane, cyclohexane, hexane, methyl pentane, and dimethyl butane.

The aromatic compound useful as an enhancement agent is of the formula: $C_6H_n$—$X_{6-n}$ where n is 0 to 6. X can be hydroxyl, halogen or any of the alkane, alcohol, ether groups listed above. Examples of these aromatics are benzene, toluene, xylene, ethylbenzene, cumene, mesitylene, hemimellitine, pseudocumene, butylbenzene, phenol and benzotrifluoride. Among the most preferred are toluene, xylene and mesitylene.

The amine useful as an enhancement agent is of the formula: $NR_7R_8R_9$ where $R_7$, $R_8$ and $R_9$ can be hydrogen, hydroxyl, $C_1$-$C_{10}$ alkyl, $C_1$-$C_{10}$ alcohol. $R_7$, $R_8$ and $R_9$ can all be the same or independently different. Examples of these amines are methylamine, dimethylamine, trimethylamine, ethylamine, diethylamine, triethylamine, n-propylamine, di-n-propylamine, tri-n-propylamine, isopropylamine, di-isopropylamine, tri-isopropylamine, n-butylamine, isobutylamine, sec-butylamine, tert-butylamine, ethanolamine, diethanolamine, triethanolamine, amino methyl propanol and hydroxylamine. Most preferred are butylamines and triethylamine.

The siloxane useful as an enhancement agent is a volatile methyl siloxane. Three examples of these are hexamethyl disiloxane, octamethyl trisiloxane and decamethyl tetrasiloxane. Most preferred is hexamethyl disiloxane.

The terpene useful as an enhancement agent contains at least one isoprene group of the general formula:

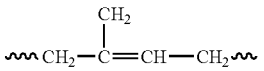

The molecule may be cyclic or multicyclic. Preferred examples are d-limonene, pinene, terpinol, turpentine and dipentene.

The dibasic ester which can be used as an enhancement agent is of the formula: $R_{10}$—COO—$R_{11}$—COO—$R_{12}$ where $R_{10}$ is $C_1$-$C_{20}$ alkyl, $C_5$-$C_6$ cycloalkyl, benzyl, furanyl or tetrahydrofuranyl, $R_{11}$, is $C_1$-$C_{20}$ alkyl, $C_5$-$C_6$ cycloalkyl, benzyl, phenyl, furanyl or tetrahydrofuranyl, $R_{12}$ is $C_1$-$C_{20}$ alkyl, $C_5$-$C_6$ cycloalkyl, benzyl, furanyl or tetrahydrofuranyl. Examples of these dibasic esters are dimethyl oxalate, dimethyl malonate, dimethyl succinate, dimethyl glutarate, dimethyl adipate, methyl ethyl succinate, methyl ethyl adipate, diethyl succinate, diethyl adipate. In the formula, $R_{10}$, $R_{11}$, and $R_{12}$, which can be the same or different, are preferably $C_1$ to $C_6$ alkyl or alkynyl, more preferably $C_1$ to $C_4$ alkyl. Among the most preferred are dimethyl succinate, and dimethyl adipate.

The glycol ether component which can be used as an enhancement is of the formula: $R_{13}$—O—$R_{14}$—O—$R_{15}$ where $R_{13}$ is $C_2$-$C_{20}$ alkyl, $C_5$-$C_6$ cycloalkyl, benzyl, furanyl or tetrahydrofuranyl, $R_{14}$ is $C_1$-$C_{20}$ alkyl, $C_5$-$C_6$ cycloalkyl, benzyl, phenyl, furanyl or tetrahydrofuranyl, $R_{15}$ is hydrogen or an alcohol as defined above. Examples of these glycol ethers are ethylene glycol methyl ether, diethylene glycol methyl ether, ethylene glycol ethyl ether, diethylene glycol ethyl ether, ethylene glycol propyl ether, diethylene glycol propyl ether, ethylene glycol butyl ether, diethylene glycol butyl ether, propylene glycol methyl ether, dipropylene glycol, dipropylene glycol methyl ether, propylene glycol propyl ether, dipropylene glycol propyl ether, methyl methoxybutanol, propylene glycol butyl ether, and dipropylene glycol butyl ether. Among the most preferred are propylene glycol butyl ether, dipropylene glycol methyl ether, dipropylene glycol, methyl methoxybutanol, dipropylene glycol butyl ether and diethylene glycol butyl ether.

The pyrrolidone enhancement agent is substituted in the N position of the pyrrolidone ring by hydrogen, $C_1$ to $C_8$ alkyl, or $C_1$ to $C_8$ alkanol. Examples of these pyrrolidones are pyrrolidone, N-methylpyrrolidone, N-ethyl pyrrolidone, N-propyl pyrrolidone, N-hydroxymethyl pyrrolidone, N-hydroxyethyl pyrrolidone, and N-hexyl pyrrolidone. Among the most preferred are N-methylpyrrolidone and N-ethyl pyrrolidone.

The halogenated hydrocarbon enhancement agent is of the formula: $R_{16}$—$X_y$ where $R_{16}$ is $C_1$-$C_{20}$ alkyl, $C_4$-$C_{10}$ cycloalkyl, $C_2$-$C_{20}$ alkenyl benzyl, phenyl, fluoroethyl, and X is chlorine, bromine fluorine or iodine and y is not 0, and the Ozone Depletion Potential (ODP) of the molecule <0.15. Examples of these chlorinated materials are methyl chloride, methylene chloride, ethyl chloride, dichloro ethane, propyl chloride, n-propyl bromide, isopropyl chloride, propyl dichloride, butyl chloride, isobutyl chloride, sec-butyl chloride, tert-butyl chloride, pentyl chloride, and hexyl chloride. Among the most preferred are methylene chloride, and n-propyl bromide.

The inventive compositions are intended to be used in a similar manner as CFC's and chlorinated solvents, which have been widely used in the past in cleaning applications. These mixtures may be used in various techniques of cleaning which would be apparent to one skilled in the art such as spraying, spray under immersion, vapor degreasing/cleaning, immersion at either the boiling point or below the boiling point, wiping with cloths and brushes, immersion with ultrasonics, immersion with tumbling and spraying into air. These techniques were used to clean hard surfaces of items and were also used to clean textiles.

The compositions are also intended to be used in a similar manner as CFC's and chlorinated solvents, which have been widely used in past solvating applications. These mixtures may be used as a solvent in adhesives, paints, chemical processes, and other applications in which the solubility parameter of the solvent dissolved the solid or liquid, and/or exhibited appropriate volatility for the application.

The key to the success of these mixtures as solvents and cleaning agents is the fact that it is desirable for these mixtures to be formulated to have no flash point. This is important because it allows the solvent to be used safely without the threat of flammability as was found in similar solvents, which had the same volatility. As such the highly fluorinated material described becomes necessary in most mixtures to retard the closed cup flash point of the mixture.

Although not required it is desirable that the mixture forms an azeotrope-like mixture. This is desirable because it allows for a consistent flash point and allows the product to be distilled and recovered.

DESCRIPTION OF THE PREFERRED EMBODIMENTS

In accordance with the invention, novel compositions have been formulated comprising dichloroethylene and alkoxy-substituted perfluoro compounds that contain six carbon atoms (HFE6C) with, if required, highly fluorinated materials to retard flammability and/or with other enhancement agents that improve and enhance the properties.

The resultant composition can be formulated to have acceptable low ozone depletion potential, and will have some or all of the similar desirable characteristics of CFC's and chlorinated solvents of: cleaning ability, compatibility, volatility, viscosity, solvating ability, drying ability, low or no VOC, and/or surface tension character. In addition, desired blends will exhibit no flash points in keeping in character with the CFC and chlorinated based solvents.

The content of the enhancement components in the mixture of the present invention is not particularly limited, but for the addition of an effective amount necessary to improve or control solubility, volatility, boiling point, flammability, surface tension, viscosity, reactivity, and material compatibility.

Preferably the level of the dichloroethylene component will exceed 50% by weight of the mixture and the HFE6C will be less than 30% by weight of the mixture. The amount of dichloroethylene is 50-99.9 weight percent, preferably 50-99 weight percent, more preferably 50-90 weight percent, and still more preferably 60-80 weight percent. The amount of highly fluorinated ether is 0.1-30 weight percent, preferably 10-30 weight percent, and more preferably 15-25 weight percent. Addition of the highly fluorinated material is required to modify physical properties of the mixture such as flash point, and the addition of other optional materials is required to improve the efficacy of the mixture or to assist in creating an azeotrope or an azeotrope-like mixture which is preferred.

As used in this specification and claims, effective amounts for azeotropes is defined as the amount of each component of the inventive compositions that, when combined, results in the formation of an azeotropic or azeotrope-like composition. This definition includes the amounts of each component, which amounts vary depending on the pressure applied to the composition, so long as the azeotropic or azeotrope-like, or constant boiling or substantially constant boiling compositions continue to exist at different pressures, but with possible different boiling points. Therefore, effective amount includes the weight percentage of each component of the composition of the instant invention, which forms azeotropic or azeotrope-like, or constant boiling or substantially constant boiling, compositions at pressures other than atmospheric pressure.

It is possible to characterize, in effect, a constant boiling mixture, which may appear under many guises, depending on the conditions chosen, by any of several criteria:

A composition can be defined as an azeotrope of A, B, and C, since the term "azeotrope" is at once both definitive and limitative, and requires that-effective amounts of A, B, and C form this unique composition of matter, which is a constant boiling mixture.

It is well known by those skilled in the art that at different pressures, the composition of a given azeotrope will vary, at least to some degree, and changes in pressure will also change, at least to some degree, the boiling point. Thus an azeotrope of A, B, and C represents a unique type of relationship but with a variable composition which depends on temperature and/or pressure. Therefore compositional ranges rather than fixed compositions are often used to describe azeotropes.

The composition can be defined as a particular weight percent relationship or mole percent relationship of A, B, and C, while recognizing that such specific values point out only one particular such relationship and that in actuality, a series of such relationships, represented by A, B, and C actually exist for a given azeotrope, varied by the influence of pressure.

Azeotrope A, B, and C can be characterized by defining the composition as an azeotrope characterized by a boiling point at a given pressure, thus giving identifying characteristics without unduly limiting the scope of the invention by a specific numerical composition which is limited by and is only as accurate as the analytical equipment available.

The following ternary compositions are characterized as azeotropic or azeotrope-like in that compositions within these ranges exhibit substantially constant boiling point at constant pressure. These ternary azeotrope like compositions being substantially constant boiling, the compositions do not tend to fractionate to any great extent upon evaporation at standard conditions. After evaporation, only a small difference exists between the composition of the vapor and the composition of the initial liquid phase. This difference is such that the composition of the vapor and liquid phases are considered substantially the same and are azeotropic or azeotrope like in their behavior.

1) 50-80 weight percent 1,2-trans-dichloroethylene (TDCE), 10-30 weight percent nonafluorobutane ethyl ether (HFE-7200), and 0.1-10 weight percent methanol.

2) 50-80 weight percent TDCE, 10-30 weight percent HFE-7200, and 0.1-7 weight percent ethanol.

3) 50-80 weight percent TDCE, 10-30 weight percent HFE-7200, and 0.1-5 weight percent 1-propanol.

4) 50-80 weight percent TDCE, 10-30 weight percent HFE-7200, and 0.1-5 weight percent 2-propanol (IPA).

5) 50-80 weight percent TDCE, 10-30 weight percent HFE-7200, and 0.1-2.5 weight percent t-butanol.

6) 50-80 weight percent TDCE, 10-30 weight percent HFE-7200, and 0.1-5 weight percent methylal.

7) 50-80 weight percent TDCE, 10-30 weight percent HFE-7200, and 0.1-2.5 weight percent methyl acetate.

8) 50-80 weight percent TDCE, 10-30 weight percent HFE-7200, and 0.1-7 weight percent acetone.

9) 50-80 weight percent TDCE, 10-30 weight percent (FE-7200, and 1-40 weight percent methylene chloride.

The following ternary compositions have been established, within the accuracy of successive distillation methods, as true ternary azeotropes at substantially atmospheric pressure.

1) 66 weight percent TDCE, 26.5 weight percent HFE-7200, and 7.5 weight percent methanol, boiling point of about 106° F. (about 41° C.).

2) 68.5 weight percent TDCE, 27 weight percent HFE-7200, and 4.5 weight percent methanol, boiling point of about 116° F. (about 47° C.).

3) 71 weight percent TDCE, 28.5 weight percent HFE-7200, and 0.5 weight percent 1-propanol, boiling point of about 116° F. (about 47° C.).

4) 70.5 weight percent TDCE, 27.5 weight percent HFE-7200, and 2 weight percent IPA boiling point of about 116° F. (about 47° C.).

5) 72 weight percent TDCE, 27.5 weight percent HFE-7200, and 0.5 weight percent t-butanol, boiling point of about 116° F. (about 47° C.).

6) 69.5 weight percent TDCE, 28 weight percent HFE-7200, and 2.5 weight percent methylal, boiling point of about 116° F. (about 47° C.).

7) 72 weight percent TDCE, 27.5 weight percent HFE-7200, and 0.5 weight percent methyl acetate, boiling point of about 116° F. (about 47° C.).

8) 72 weight percent TDCE, 26 weight percent HFE-7200, and 2 weight percent acetone, boiling point of about 115° F. (about 47° C.).

9) 52 weight percent TDCE, 23.5 weight percent HFE-7200, and 24.5 weight percent methylene chloride, boiling point of about 110° F. (about 43° C.).

The following multicomponent compositions are characterized as azeotropic or azeotrope-like in that compositions within these ranges exhibit substantially constant boiling point at constant pressure. These mixtures were selected as a result of adding a material from a final group of selected highly fluorinated compounds to the ternary azeotrope-like blend. In most instances the purpose of its addition was to retard the flashpoint. However, the addition of the highly fluorinated compound in many ways formed unique mixtures in creating two ternary azeotrope-like mixtures that overlapped each other and had similar boiling points and compositions. Being substantially constant boiling, the compositions do not tend to fractionate to any great extent upon evaporation up to 50% of the mass. Since the mixtures are not easily fractionated, they are useful commercially in standard cleaning apparatuses for cold cleaning and vapor degreasing. After evaporation of half the mass, small differences of less than 10% exist between the composition of the vapor and the composition of the initial liquid phase. This difference is such that the composition of the vapor and liquid phases are considered substantially the same and are either azeotropic or azeotrope like in their behavior. This is a blend that is suitable for commercial use.

1) 50-88 weight percent TDCE, 10-30 weight percent HFE-7200, 0.1-10 weight percent methanol, and 1-25 weight percent 1,1,1,2,3,4,4,5,5,5-decafluoropentane (HFC-43-10mee).

2) 50-88 weight percent TDCE, 10-30 weight percent HFE-7200, 0.1-6 weight percent ethanol, and 1-25 weight percent HFC-43-10mee.

3) 50-88 weight percent TDCE, 10-30 weight percent HFE-7200, 0.1-5 weight percent 2-propanol, and 1-25 weight percent HFC-43-10mee.

4) 50-88 weight percent TDCE, 10-30 weight percent HFE-7200, 0.1-10 weight percent acetone, and 1-25 weight percent HFC-43-10mee.

5) 50-88 weight percent TDCE, 10-30 weight percent HFE-7200, 0.1-8 weight percent methylal, and 1-25 weight percent HFC-43-10mee.

6) 50-88 weight percent TDCE, 10-30 weight percent HFE-7200, 0.1-6 weight percent methanol, 0.1-4 weight percent ethanol. and 1-25 weight percent HFC-43-10mee.

7) 50-88 weight percent TDCE, 10-30 weight percent HFE-7200, 0.1-6 weight percent methanol, 0.1-4 weight percent 2-propanol, and 1-25 weight percent HFC-43-10mee.

8) 50-88 weight percent TDCE, 10-30 weight percent HFE-7200, 0.1-6 weight percent methanol, 0.1-4 weight percent methylal, and 1-25 weight percent HFC-43-10mee.

9) 50-88 weight percent TDCE, 10-30 weight percent HFE-7200, 0.1-6 weight percent methanol, 0.1-4 weight percent cyclopentane, and 1-25 weight percent HFC-43-10mee.

10) 50-88 weight percent TDCE, 10-30 weight percent HFE-7200, 0.1-4 weight percent ethanol, 0.1-4 weight percent 2-propanol. and 1-25 weight percent HFC-43-10mee.

11) 50-88 weight percent TDCE, 10-30 weight percent HFE-7200, 0.1-10 weight percent methanol, and 1-25 weight percent HFE-7100.

12) 50-88 weight percent TDCE, 10-30 weight percent HFE-7200, 0.1-6 weight percent ethanol, and 1-25 weight percent HFE-7100.

13) 50-88 weight percent TDCE, 10-30 weight percent HFE-7200, 0.1-5 weight percent 2-propanol, and 1-25 weight percent HFE-7100.

14) 50-88 weight percent TDCE, 10-30 weight percent HFE-7200, 0.1-10 weight percent acetone, and 1-25 weight percent HFE-7100.

15) 50-88 weight percent TDCE, 10-30 weight percent HFE-7200, 0.1-8 weight percent methylal, and 1-25 weight percent HFE-7100.

16) 50-88 weight percent TDCE, 10-30 weight percent HFE-7200, 0.1-6 weight percent methanol, 0.1-4 weight percent ethanol, and 1-25 weight percent HFE-7100.

17) 50-88 weight percent TDCE, 10-30 weight percent HFE-7200, 0.1-6 weight percent methanol, 0.1-4 weight percent 2-propanol, and 1-25 weight percent HFE-7100.

18) 50-88 weight percent TDCE, 10-30 weight percent HFE-7200, 0.1-6 weight percent methanol, 0.1-4 weight percent methylal, and 1-25 weight percent (HFE-7100.

19) 50-88 weight percent TDCE, 10-30 weight percent HFE-7200, 0.1-6 weight percent methanol, 0.1-4 weight percent cyclopentane, and 1-25 weight percent HFE-7100.

20) 50-88 weight percent TDCE, 10-30 weight percent HFE-7200, 0.1-4 weight percent ethanol, 0.1-4 weight percent 2-propanol, and 1-25 weight percent HFE-7100.

The following multicomponent compositions have been established, within the accuracy of simple one plate distillation methods, as azeotrope-like blends that are preferred. The compositions are characterized by having no flash points and have stable compositions upon distillation of approximately 50% of the original mixture. The noted boiling point range is at atmospheric pressure.

1) 60-78 weight percent TDCE, 10-30 weight percent HFE-7200, 0.1-7 weight percent methanol, and 1-15 weight percent HFC-43-10mee, boiling point range of 108-116° F. (42-47° C.).

2) 60-78 weight percent TDCE, 10-30 weight percent HFE-7200, 0.1-4 weight percent ethanol and 1-15 weight percent HFC-43-10mee, boiling point range of 116-119° F. (47-48° C.).

3) 60-78 weight percent TDCE, 10-30 weight percent HFE-7200, 0.1-4 weight percent 2-propanol, and 1-15 weight percent HFC-43-10mee, boiling point range of 116-119° F. (47-48° C.)

4) 60-78 weight percent TDCE, 10-30 weight percent HFE-7200, 0.1-4 weight percent acetone, and 1-15 weight percent HFC-43-10mee, boiling point range of 114-119° F. (46-48° C.).

5) 60-78 weight percent TDCE, 10-30 weight percent HFE-7200, 0.1-4 weight percent methylal, and 1-15 weight percent HFC-43-10mee, boiling point range of 116-119° F. (47-48° C.).

6) 60-78 weight percent TDCE, 10-30 weight percent HFE-7200, 0.1-4 weight percent methanol, 0.1-2 weight percent ethanol, and 1-15 weight percent HFC-43-10, boiling point range of 113-117° F. (45-47° C.)

7) 60-78 weight percent TDCE, 10-30 weight percent HFE-7200, 0.1-4 weight percent methanol, 0.1-2 weight percent 2-propanol, and 1-15 weight percent HFC-43-10mee, boiling point range of 113-117° F. (45-47° C.).

8) 60-78 weight percent TDCE, 10-30 weight percent HFE-7200, 0.1-4 weight percent methanol, 0.1-3 weight percent methylal, and 1-15 weight percent HFC-43-10mee, boiling point range of 116-119° F. (47-48° C.).

9) 60-78 weight percent TDCE, 10-30 weight percent HFE-7200, 0.1-4 weight percent methanol, 0.1-2 weight percent cyclopentane, and 1-15 weight percent HFC-43-10mee, boiling point range of 106-115° F. (41-46° C.)

10) 60-78 weight percent TDCE, 10-30 weight percent HFE-7200, 0.1-4 weight percent ethanol, 0.1-4 weight percent 2-propanol, and 1-15 weight percent HFC-43-10mee, boiling point range of 116-119° F. (47-48° C.)

11) 60-78 weight percent TDCE, 10-30 weight percent HFE-7200, 0.1-5.5 weight percent methanol, and 1-18 weight percent HFE-7100, boiling point range of 105-111° F. (41-44° C.).

12) 60-78 weight percent TDCE, 10-30 weight percent HFE-7200, 0.1-3.5 weight percent ethanol, and 1-18 weight percent HFE-7100, boiling point range of 115-119° F. (46-48° C.)

13) 60-78 weight percent TDCE, 10-30 weight percent HFE-7200, 0.1-4 weight percent 2-propanol, and 1-18 weight percent HFE-7100, boiling point range of 116-118° F. (47-48° C.).

14) 60-78 weight percent TDCE, 10-30 weight percent HFE-7200, 0.1-3 weight percent acetone, and 1-18 weight percent HFE-7100, boiling point range of 113-116° F. (45-47° C.)

15) 60-78 weight percent TDCE, 10-30 weight percent HFE-7200, 0.1-3 weight percent methylal, and 1-18 weight percent HFE-7100, boiling point range of 116-119° F. (47-48° C.).

16) 60-78 weight percent TDCE, 10-30 weight percent HFE-7200, 0.1-3 weight percent methanol, 0.1-2 weight percent ethanol, and 1-20 weight percent HFE-7100, boiling point range of 113-116° F. (45-47° C.).

17) 60-78 weight percent TDCE, 10-30 weight percent HFE-7200, 0.1-3 weight percent methanol, 0.1-2 weight percent 2-propanol, and 1-20 weight percent HFE-7100, boiling point range of 113-117° F. (45-47° C.)

18) 60-78 weight percent TDCE, 10-30 weight percent HFE-7200, 0.1-3 weight percent methanol, 0.1-2 weight percent methylal, and 1-20 weight percent HFE-7100, boiling point range of 113-117° F. (45-47° C.)

19) 60-78 weight percent TDCE, 10-30 weight percent HFE-7200, 0.1-3 weight percent methanol, 0.1-2 weight percent cyclopentane, and 1-20 weight percent HFE-7100, boiling point range of 105-110° F. (41-43° C.).

20) 60-78 weight percent TDCE, 10-30 weight percent HFE-7200, 0.1-4 weight percent ethanol, 0.1-4 weight percent 2-propanol, and 1-20 weight percent HFE-7100, boiling point range of 116-119° F. (47-48° C.).

It is preferred that inhibitors be added to the compositions to inhibit decomposition, react with undesirable decomposition products of the compositions, and/or prevent corrosion of metal surfaces. Any and all of the following classes of inhibitors may be employed in the invention, some of which may serve a dual purpose as suitable components for cleaning and solvating. Preferred are alkanols having 4 to 7 carbon atoms, nitroalkanes having 1 to 3 carbon atoms, 1, 2 epoxyalkanes having 2 to 7 carbon atoms, acetylene alcohols having 3 to 9 carbon atoms, phosphite esters having 12 to 30 carbon atoms, ethers having 3 to 6 carbon atoms, unsaturated hydrocarbon compounds having 4 to 7 carbon atoms, triazoles, acetals having 4 to 7 carbon atoms, ketones having 3 to 5 carbon atoms, and amines having 6 to 8 carbon atoms. Other suitable inhibitors will be readily apparent to those skilled in the art.

Inhibitors may be used alone or in mixtures in any proportions. Typically less than 5 weight percent and, preferably, less than 2 weight percent of inhibitor based on the total weight of the mixture may be used.

In addition, the composition of the present invention may further contain surfactants, emulsifying agents, wetting agents, water, perfumes, indicators, or colorants.

The compositions of the invention are useful for solvating, vapor degreasing, photoresist stripping, adhesive removal, aerosol, cold cleaning, and solvent cleaning applications including defluxing, dry cleaning, degreasing, particle removal, metal and textile cleaning.

EXAMPLES 1-10

The azeotropic mixtures of this invention were initially identified by screening mixtures of dichloroethylene/HFE6C and various organic solvents. The selected mixtures were distilled in a Kontes multistage distillation apparatus using a Snyder distillation column. The distilled overhead composition was analyzed using a Hewlett-Packard Gas Chromatograph using a FID detector and a HP-4 column. The overhead composition was compared to the feed composition to identify the azeotropic composition. If the feed and overhead compositions differed then the overhead material was collected and re-distilled until successive distillation compositions were within 2% of the feed composition, indicating an azeotrope. The method was also supplemented by recording temperatures of the feed at boiling at approximately 1 atmosphere (room pressure). The presence of an azeotrope was also indicated when the test mixture exhibited a lower boiling point than the boiling point of the subsequent feed mixture. Results obtained are summarized in Table 1.

EXAMPLE 11

The ten azeotrope-like compositions given in Table 1 were tested to determine the cleaning and solvating of the compositions on three soils, two types of flux and machine oil. The soils were applied to a test FR-4 substrate and then were immersed into a beaker of the mixture at room temperature with minimal agitation. All 10 mixtures easily cleaned the soils from the substrates in less than 5 minutes. The cleaning was observed to be faster with those blends that contained the addition of component B from the previously mentioned candidates. This was observed to be true when cleaning no-clean flux residues.

The results of this example were encouraging based on the fact that when dichloroethylene compositions are greater than 50% by weight in a mixture, the blend was usually found to be effective on difficult soils such as no-clean flux residues. A drawback of this example is that over half of the mixtures cited exhibited flash points which is not preferred. Usually flash points were the result of the addition of a component B at levels greater than 0.1% weight percent which gave the mixture better cleaning properties but at the expense of creating a flash point.

EXAMPLES 12-21

Cleaning/solvating compositions were made using dichloroethylene compounds (I) with alkoxy-substituted perfluoro compounds that contain six carbons (HFE6C) (II), with highly fluorinated materials (A) to retard flammability and with other enhancement agents that improve and enhance the properties of the original mixture were tested (B). Tests were conducted to determine the cleaning and solvating of the solvent mixtures using the same method as previously discussed. Flash points were also observed in checking the ability to light the mixture in a beaker at room temperature and pressure in a modified open cup flash point test.

TABLE 1

Azeotrope-like Compositions

| Example/ Mixture | Dichloroethylene Component (I) | Alkoxy-substituted perfluoro compounds Component (II) | Other Material Component A & B | Weight Percent Component (I) | Weight Percent Component (II) | Weight Percent Other Material Component A & B | Azeotrope Boiling Point ° F./° C. @ 1 atm | Flash Point |
|---|---|---|---|---|---|---|---|---|
| 1 | TDCE | HFE-7200 | None | 68% | 32% | 0% | 118/48 | None |
| 2 | TDCE | HFE-7200 | Methanol | 66% | 26.5% | 7.5% | 106/41 | Yes |
| 3 | TDCE | HFE-7200 | Ethanol | 68.5% | 27% | 4.5% | 116/47 | Yes |
| 4 | TDCE | HFE-7200 | 1-Propanol | 71% | 28.5% | 0.5% | 116/47 | None |
| 5 | TDCE | HFE-7200 | 2-Propanol | 70.5% | 27.5% | 2% | 116/47 | Yes |
| 6 | TDCE | HFE-7200 | t-Butanol | 72% | 27.5% | 0.5% | 116/47 | None |
| 7 | TDCE | HFE-7200 | Methylal | 69.5% | 28% | 2.5% | 116/47 | Yes |
| 8 | TDCE | HFE-7200 | Methyl Acetate | 72% | 27.5% | 0.5% | 116/47 | None |
| 9 | TDCE | HFE-7200 | Acetone | 72% | 26% | 2% | 115/47 | Yes |
| 10 | TDCE | HFE-7200 | Methylene Chloride | 52% | 23.5% | 24.5% | 110/43 | None |

TABLE 2

Multicomponent Compositions Testing

| Example/ Mixture | Dichloro-ethylene Com-ponent (I) | Alkoxy-substituted perfluoro compounds Component (II) | Highly Fluorinated Material (A) | Other Material Component (B) | Weight Percent (I) | Weight Percent (II) | Weight Percent (A) | Weight Percent (B) | Cleans Oil | Cleans Rosin Fluxes | Cleans No-Clean Fluxes | Flamm-able |
|---|---|---|---|---|---|---|---|---|---|---|---|---|
| 12 | (TDCE) | HFE-7200 | HFC-43-10 mee | Methanol | 70% | 18% | 8% | 4% | Yes | Yes | Yes | No |
| 13 | TDCE | HFE-7200 | HFC-43-10 mee | Methanol Ethanol | 66% | 22% | 9% | 1% 2% | Yes | Yes | Yes | No |
| 14 | TDCE | HFE-7200 | HFC-43-10 mee | 2-Propanol | 72% | 16% | 9% | 3% | Yes | Yes | Yes | No |
| 15 | TDCE | HFE-7200 | HFC-43-10 mee | Methylal | 66% | 21% | 10% | 3% | Yes | Yes | Yes | No |
| 16 | TDCE | HFE-7200 | HFC-43-10 mee | Methanol Cyclo-pentane | 69% | 18% | 9% | 3% 1% | Yes | Yes | Yes | No |
| 17 | TDCE | HFE-7200 | HFE-7100 | Methanol | 68% | 19% | 10% | 3% | Yes | Yes | Yes | No |
| 18 | TDCE | HFE-7200 | HFE-7100 | Methanol Ethanol | 66% | 22% | 9% | 1% 2% | Yes | Yes | Yes | No |
| 19 | TDCE | HFE-7200 | HFE-7100 | 2-Propanol Ethanol | 66% | 20% | 10% | 2% 2% | Yes | Yes | Yes | No |
| 20 | TDCE | HFE-7200 | HFE-7100 | 2-Propanol t-Butanol | 71.5% | 18% | 8% | 2% 0.5% | Yes | Yes | Yes | No |
| 21 | TDCE | HFE-7200 | HFE-7100 | Methanol Cyclo-pentane | 67% | 20% | 10% | 2% 1% | Yes | Yes | Yes | No |

It should be apparent from the foregoing detailed description that the objects set forth at the outset to the specification have been successfully achieved. Moreover, while there are shown and described present preferred embodiments of the invention, it is to be distinctly understood that the invention is not limited thereto but may be otherwise variously embodied and practiced within the scope of the following claims.

What is claimed is:

1. A method of cleaning a solid surface which comprises treating said surface with a cleaning composition comprising greater than about 50 weight percent of a dichioroethylene (I) and one or more alkoxy-substituted perfluoro compounds that contain six carbon atoms (HFE6C) of the formula (II) $R_1$—O—$R_2$ where $R_1$ is perfluorobutyl and $R_2$ is ethyl, or $R_1$ is perfluoropentyl and $R_2$ is methyl, or mixtures thereof, and an additive selected from the group consisting of:

(A) a highly fluorinated compound of the formula $C_aF_bH_cX_d$ where a is an integer from 2 to 8, b is an integer greater than a but less than 2a+2, d is 0, 1, or 2, and c is less than or equal to 2a+2−b−d and X is O, N, halogen, or Si, and combinations thereof;

(B) an enhancement agent selected from the group consisting of alcohols, esters, ethers, cyclic ethers, ketones, alkanes, aromatics, amines, siloxanes, terpenes, dibasic esters, glycol ethers, pyrrolidones, low or non-ozone depleting halogenated hydrocarbons, and mixtures thereof; and (C) mixtures thereof.

2. The method of claim 1, wherein the solid surface is a printed circuit board, silicon wafer, electrical component or microelectronic device.

3. The method of claim 1, wherein the solid surface is an optical device, lens or optical mold.

4. The method of claim 1, wherein the solid surface is metal, plastic, cloth or glass.

5. The method of claim 1, wherein the composition is contacted with the surface at a temperature from 32° F. (0° C.) to and including the boiling point of the composition.

6. The method of claim 1 wherein the solid surface is heated to a temperature above the boiling point of the composition then the solid surface is contacted with the composition.

7. The method of claim 6 wherein the mixture is contacted with the heated surface as a liquid or an aerosol.

8. The method of claim 1, where the mixture is contacted with the surface as an aerosol.

9. The method of claim 1, where the mixture is contacted with the surface as a liquid.

10. The method of claim 1, where the mixture is contacted with the surface as a vapor.

11. A method of solvating a solid or liquid material by contacting said material with a composition comprising greater than about 50 weight percent of a dichloroethylene (I) and one or more alkoxy-substituted perfluoro compounds that contain six carbon atoms (HFE6C) of the formula (II) $R_1$—O—$R_2$ where $R_1$ is perfluorobutyl and $R_2$ is ethyl, or $R_1$ is perfluoropentyl and $R_2$ is methyl, or mixtures thereof, and an additive selected from the group consisting of:

(A) a highly fluorinated compound of the formula $C_aF_bH_cX_d$ where a is an integer from 2 to 8, b is an integer greater than a but less than 2a+2, d is 0, 1, or 2, and c is less than or equal to 2a+2−b−d and X is O, N, halogen, or Si, and combinations thereof;

(B) an enhancement agent selected from the group consisting of alcohols, esters, ethers, cyclic ethers, ketones, alkanes, aromatics, amines, siloxanes, terpenes, dibasic esters, glycol ethers, pyrrolidones, low or non-ozone depleting halogenated hydrocarbons, and mixtures thereof; and (C) mixtures thereof.

12. The method of claim 11, where the composition is contacted with the material in a temperature range from 32° F. (0° C.) to and including the boiling point of the composition to thereby dissolve the material.

13. The method of claim 2, wherein the solid surface to be cleaned is contaminated with flux, resin, adhesive, oil, grease, photoresist, polymers, or combinations thereof.

14. The method of claim 3, wherein the solid surface to be cleaned is contaminated with flux, rosin, ink, wax, dirt, resin, adhesive, buffing compound, oil, grease, polymers, or combinations thereof.

15. The method of claim 4, wherein the solid surface to be cleaned is contaminated with dirt, flux, rosin, resin, ink, wax, adhesive, paint, latex, oil, polymers, or combinations thereof.

* * * * *